United States Patent [19]

Miller

[11] Patent Number: 4,935,989

[45] Date of Patent: Jun. 26, 1990

[54] PNEUMATIC DOOR CLOSER WITH SUSTAINED CLOSING FORCE DURING CLOSURE

[76] Inventor: Cardell E. Miller, P.O. Box 183, Hudson, Wis. 54016

[21] Appl. No.: 353,883

[22] Filed: May 18, 1989

Related U.S. Application Data

[63] Continuation-in-part of Ser. No. 190,404, May 5, 1988, abandoned.

[51] Int. Cl.[5] ..... E05F 3/00

[52] U.S. Cl. ..... 16/66; 16/DIG. 10

[58] Field of Search ..... 16/66, 49, 70, DIG. 9, 16/DIG. 10

[56] References Cited

U.S. PATENT DOCUMENTS 628,916 7/1899 Bitne ..... 16/DIG. 9

1,916,571 7/1933 Hoffman ..... 16/66

*Primary Examiner*—Nicholas P. Godici

*Assistant Examiner*—Carmine Cuda

*Attorney, Agent, or Firm*—Allan O. Maki

[57] ABSTRACT

A door closer is provided of the cylinder/piston type wherein the closer is pivotably mounted to the door at a point adjacent to the piston rod end of the cylinder; a leaf type helper spring may be added between the cylinder and the door; said configuration being capable of providing increased closing force to the door as the door closes.

3 Claims, 4 Drawing Sheets

PNEUMATIC DOOR CLOSER WITH SUSTAINED CLOSING FORCE DURING CLOSURE

This is a continuation-in-part of copending application Ser. No 190,404 filed on May 5, 1988, now abandoned.

FIELD OF THE INVENTION

The present invention related to improved door closer. More particularly, the door closers of the present invention include a cylinder and piston type construction utilizing an internal compression spring, in which the cylinder is attached to the door adjacent the rod end of said cylinder, rather than, as has hitertofore been standard, the air bleed end.

BACKGROUND OF THE INVENTION

Various types of door closer assemblies have heretofore been designed which will cause a door to close once it has been opened. Many such door closers include a pneumatic check such as an air escape valve designed to control the closing velocity of the door. A common problem which has occurred with door closers is caused by the fact that a strong closing force is needed to completely close and latch the door, but, it is too difficult to distort the spring to open the door, persons of limited strength such as the young, the elderly or infirm find it difficult to adequately open the door. In addition, in the event the closing force is high, there is a tendency for the door to close too rapidly and slam shut unless the door is equipped with a check devise which dissipates enough energy to adequately control the closing velocity. Another problem encountered by prior art door closers is the fact that it is necessary to accommodate the opening of the door more than 90° from the closed position and generally at least 100° . The use of conventional door closers requires the use of a door frame or door jam bracket having a length of approximately 3" in order to prevent the extended rod from hitting and being bent by the door when the door is fully opened.

U.S. Pat. No. 2,932,847 to Quinn discloses a modified door closer in which attachment to the door is provided through a secondary, leaf type spring. However, the spring is attached to the door at a point located outwardly of the airbleed end of the cylinder. Thus, as the door is opened, this spring tends to pull the door toward the cylinder. The novel geometry provided by the present invention is not suggested.

The present invention provides a door closer assembly which overcomes many of the shortcomings of the prior art door closers. Specifically, it is an object of the present invention to provide a door closer in which the door closing force does not diminish as the door closes to the extent experienced with conventionally mounted door closers. In a further embodiment of the invention a door closer construction is provided in which the closing force on the door actually increases as the door closes. A further advantage of the present invention is the ability to use a very short jam bracket of 1½" or less in length.

These and other objectives are achieved by the use of the configuration by which the closer is mounted to the door bracket through a pivot near the rod end of the closer rather than the opposite or air bleed end. A further embodiment of the present invention utilizes a single leaf type helper spring which approximately triples the latching force while greatly reducing the closing force in all "door open" positions. A further object of the invention is to provide such a door closer in which a self-lubricating plastic cup seal is employed which may be economically injection molded from a low friction plastic.

SUMMARY OF THE INVENTION

The present invention relates to a door closer of the cylinder and piston type in which the cylinder is attached to the door at a point adjacent to the end from which the piston rod extends. Such attachment allows the air check end of the closer to pivot away from the door as it opens, thereby effectively altering the manner in which forces are applied to the door. Attachment of the closer to the door near the rod end also makes it possible to shorten the length of the jam bracket without causing the rod to be bent by engagement with the door edge when the door is open 100° or more. The novel mounting arrangement of this invention also provides a slightly greater lever arm (i.e. the perpendicular distance between the closer rod line of action and the door hinge pivot point) in the closed or latched position.

The use of a shorten jam bracket provides the further advantage that the closing force is less in the fully opened position than with the conventional, longer jam brackets. Lessening of said force permits easier opening of the door by persons having limited physical strength. Due to the fact that the air check end of the cylinder is able to pivot away from the door as it is opened, the internal compression spring is compressed less than in closers mounted in conventional fashion. This is due to the fact that the shorter jam bracket permits opening of the door with less extension of the piston rod. Thus, proportionally less force is exerted on the closer rod, allowing for easier opening of the door.

In a further embodiment of the invention a helper spring is added between the door and the closer assembly. Said spring is preferably of a leaf type configuration and is placed so that it is located between the door and the closer cylinder. The configuration of the helper spring creates a force against the air bleed end of the cylinder such that the latching force is increased for positions of the door from 25° open to fully closed, but due to the unique geometry the force applied by the helper spring reverses when the door is opened more than approximately 25°. The helper spring thus reduces the closing force when the door is more than 25° open while increasing said force when the door is less than 25° open.

The foregoing and other objects and advantages of the present invention appear from the following detailed description. In the description, references are made to the accompanying drawings which form a part hereof, and in which there are shown by way of illustration and not of limitation preferred embodiments of the invention. Such embodiments do not limit the scope of the invention but rather the invention may be employed with various modifications and different embodiments by those skilled in the art. Reference is made to the claims herein by interpreting the breath of the invention.

DESCRIPTION OF THE PREFERRED EMBODIMENT

Figure 1:
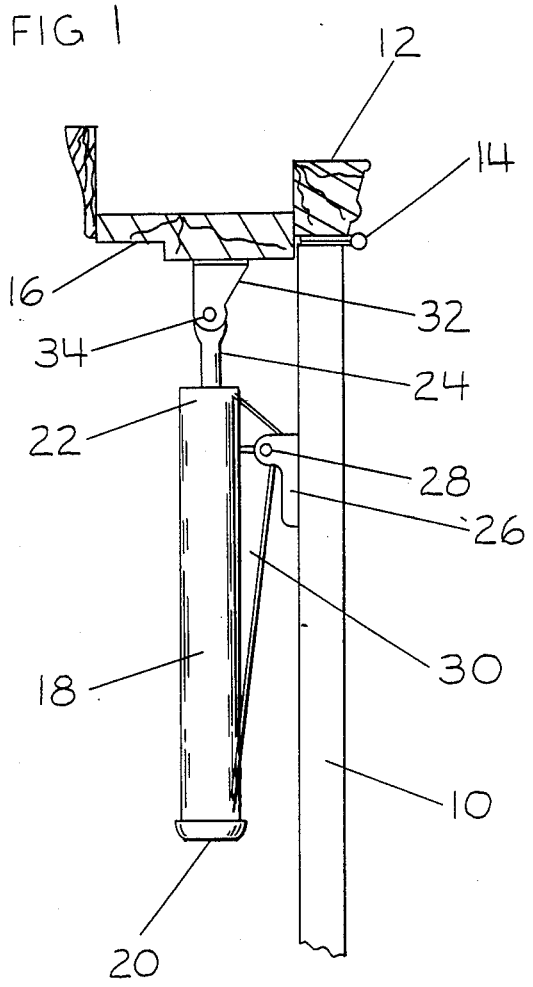
FIG. 1 is a fragmentary top view of the invention showing the associated door jam and door in the closed position.

Referring to the drawings, FIG. 1 shows a door attached to the door frame 12 by means of hinge 14. Door jam 16 of conventional configuration is also shown. Door closer 18 of the conventional cylinder type is provided having an air bleed end 20 and a rod end 22 from which is extented a rod 24 attached to an internal piston of conventional design. As shown, a mounting bracket 26 is attached to the door and is provided with a pivot 28 which engages an attaching bracket 30 on the side of cylinder 18. The end of rod 24 is pivotably attached to door jam bracket 32 by means of a pin 34.

Figure 2:
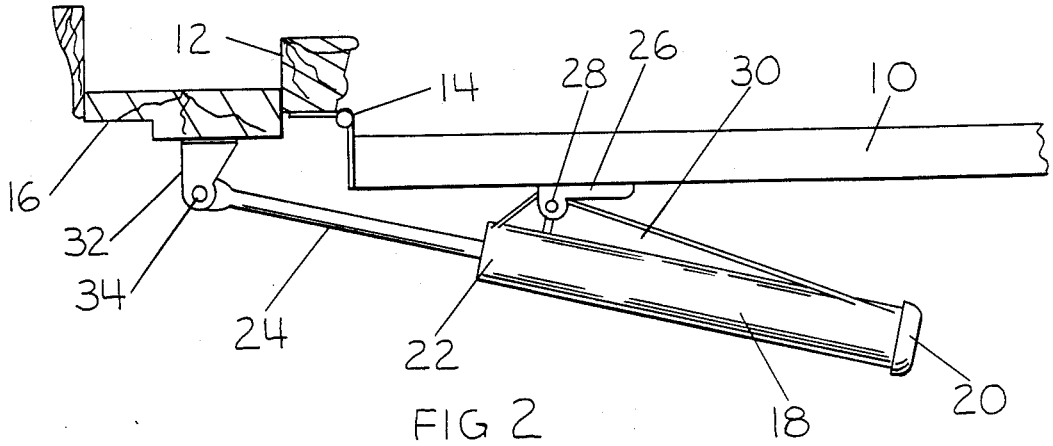
FIG. 2 is a fragmentary top view of the door jam and door of FIG. 1 shown in the 90° open position.

The same parts are shown in FIG. 2 which illustrates the extension of rod 24 when door 10 is in the 90° open position and further illustrates the manner in which the end of cylinder 18 pivots away from door 10 as the door opens.

Figure 3:
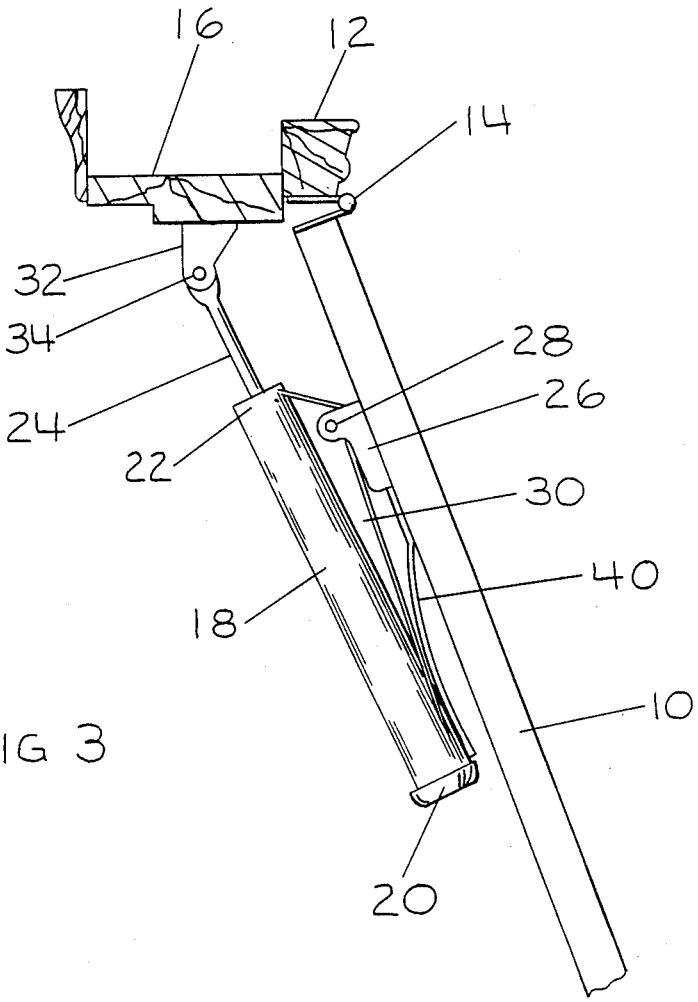
FIG. 3 is a fragmentary top view of the door, door jam and door closer utilizing a helper spring, in a 25° open position.
Figure 4:
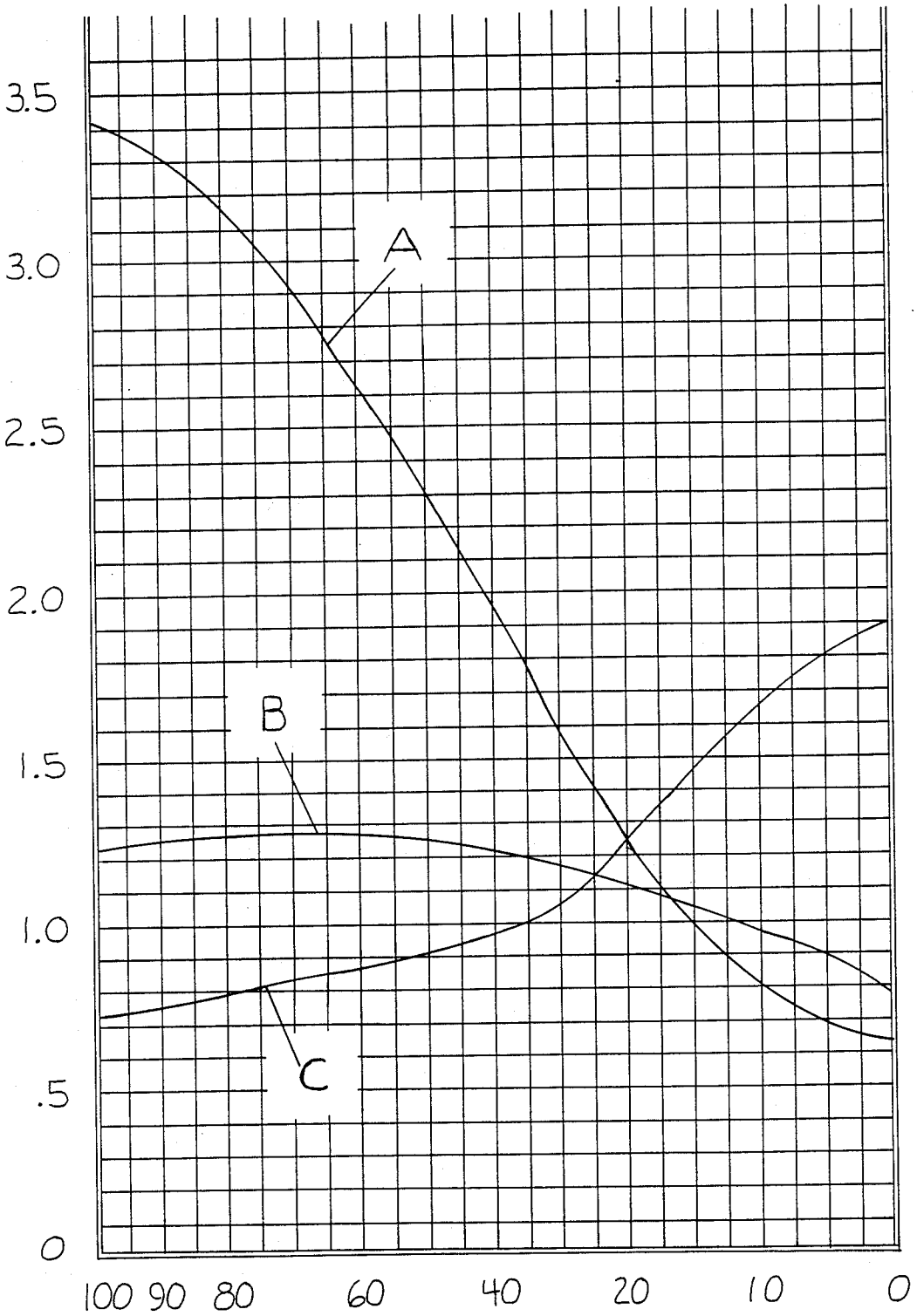
FIG. 4 is a graph illustrating the closing force exerted on the door by various types of door closers.

In FIG. 3, door 10 is shown in an approximately 25° open position. In FIG. 3 an alternative embodiment is shown wherein a helper spring 40 is positioned between the door and door closer 18. Helper spring 40 is preferably attached to mounting bracket 26 and is shaped so that it exerts a bending moment against the air bleed end of the closer tube. This bending moment adds greatly to the latching force from approximately 25° open to the fully closed or latched position. This additional force is transmitted to the stationary jam as a moment through the jam bracket pivot point and is always perpendicular to an imaginary line through the jam bracket pivot point and the door bracket pivot point. When the door is closed to a position approximately 25° open, this imaginary line extended from the jam bracket and door bracket pivot points becomes perpendicular to an imaginary line through the jam bracket and door hinge pivot so that the moment created by the helper spring forcing against the closer type is at a null relative to the door hinge point and does not provide either an opening or closing moment or force. When the door position is on the closed side of this null point the moment tends to close the door and increases as the door moves toward the closed position from the null point. When the door is open beyond the null point, the moment created by the spring tends to open the door. When added to a given door closer, the helper spring can increase the latching force nearly 3 times while actually reducing the closing force when the door is open beyond the null point. The effects of the various types of closers are illustrated in FIG. 4 wherein line A illustrates the closing force versus door position for a conventionally mounted door closer. On said graph 100° indicates a fully open position and zero degrees indicates a closed position. The vertical axis of the graph indicates an increasing closing force as one moves upward on the graph. In FIG. 4 line B indicates the same closer as in line A but with said closer mounted adjacent the rod end in accordance with the teachings of this invention. Line C indicates the combined closing force produced at different door positions utilizing the helper spring illustrated in FIG. 3. It is thus seen that whereas with conventionally mounted door closers the closing force applied to the door drops off significantly as the door is closed, there is much less drop off in the case of the present invention. With the helper spring as seen in FIG. 4 there is actually an increase in closing force as the door closes. It will thus be appreciated that in contrast with prior art door closers whereas adequate latching force is achieved only by adjusting the closer to provide a higher than desired closing force, the closers of the present invention permit the use of less stong settings thereby allowing for significantly greater ease in opening the door.

Figure 5:
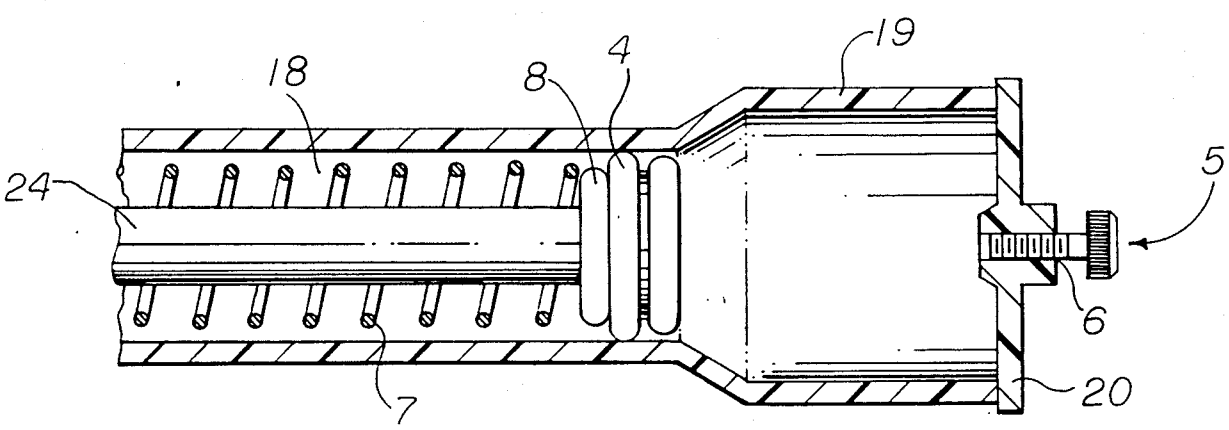
FIGS. 5 is a fragmentary cross-sectional view of a cylinder of this invention.

The internal components of the cylinder used in connection with the closer of this invention may be of conventional design. FIG. 5 illustrates one such design with the exception that cylinder 18 is provided with an enlarged diameter end 19 near its air bleed end 20. A conventional air bleed control thumb screw 5 can be threaded into an aperture 5 in accordance with prior art practice. Rod 24 is generally encircled by a coil spring 7 of conventional design. A plastic or similar disc 4 may be used as a seal, and may be held in place in conventional fashion, as, for example, by washers 2 and 8.

The benefits of the present invention become especially evident when dealing with a contemporary heavy storm door. Often high quality weather stripping of an almost air-tight nature is used which is capable of building significant air pressure between itself and the prime door during the last ¾" of closing distance. The closers of this invention are able to sustain high latching force while the air pressure between the doors gradually dissipates without requiring an irritatingly high closing force when the door is opened for passage. In such applications the use of the helper spring is particularly beneficial. A further advantage of the present invention is the possibility of eliminating conventional O-ring seals within the door closer cylinder. Such seals can be loaded into the cylinder through the air bleed end of the closer thus simplifying manufacture of the closer unit. Injection molded cup seals can be provided from self-lubricating plastics such as NYTRIL TEFLON filled polyurethane. The use of such materials eliminates the need to apply lubrication either during manufacture or during use. Such a cup seal can be used in connection with a design wherein the inner diameter of the cylinder is enlarged near the air bleed end. This type of construction allows the cup seal to be in a relaxed position when the door is closed thereby making it feasible to use various plastics in the construction of the cup seal. The door closer of the present invention may be constructed of conventional metal parts. However, in conjunction with the aforementioned self lubricating seals it is possible that the clinder 18 be constructed of a rigid plastic material, due to the reduced stresses to which the cylinder is subjected when mounted in accordance with this invention.

What is claimed is:

1. A pneumatic door closer comprising (a) a cylinder element having a movable internal piston equipped with a rod element extending through an opening in one end of said cylinder for extension and retraction, the opposite end of said cylinder having an air bleed opening;

(b) a spring mounted in said cylinder urging said piston into a retracted position, (c) means adjacent the piston rod exiting end of the cylinder for pivotably attaching said cylinder to a door at a point on said door which is adjacent to said rod exiting end when said door is in the closed position, said attaching means comprising a mounting bracket attached to the door and an attaching bracket integrally connected to one side of the cylinder, said mounting bracket being pivotably connected to said attaching bracket, (d) means at end of said piston rod element for pivotably attaching the same to a door frame by means of a door jam bracket having a length less than about 1½ inches, and (e) a resilient means extending from said means for pivotal attachment to the air bleed end of said cylinder which resilient means is adapted to push the air bleed end of said cylinder away from the door.

2. A device according to claim 1 wherein said resilient means is a leaf type spring.

3. A pneumatic door closer comprising (a) a rigid cylinder having a central opening in one end of said cylinder for passage of a rod that is adapted for extension and retraction, the opposite end of said cylinder having an adjustable air bleed opening, (b) a piston located within said cylinder having a seal, said piston being attached to said rod which extends through said opening in the cylinder, (c) a spring mounted within said cylinder around said rod urging said piston into a position wherein said rod is retracted, (d) means adjacent the end of said cylinder through which said rod extends for pivotably attaching said cylinder to a door at a point on said door which is adjacent to said rod exiting end of said cylinder in the closed position, said attaching means comprising a mounting bracket attached to the door and an attaching bracket integrally connected to one side of the cylinder, said mounting bracket being pivotably connected to said attaching bracket, a leaf spring attached to the mounting bracket and being positioned between the door and the cylinder to thereby exert a bending moment against the air bleed end of the cylinder, said leaf spring having a first end attached to the mounting bracket and a second free end which is in abutment with the air bleed end of the cylinder.

* * * * *